United States Patent [19]

Ritter et al.

[11] Patent Number: 4,860,999

[45] Date of Patent: Aug. 29, 1989

[54] DEVICE FOR HEAT-TREATING, IN PARTICULAR ANNEALING, A CONTINUOUSLY ADVANCED METAL WIRE

[75] Inventors: Gerhard Ritter; Klaus Ritter, both of Graz, Austria

[73] Assignee: EVG Entwicklungsu. Verwertungs-Gesellschaft m.b.H, Graz, Austria

[21] Appl. No.: 144,256

[22] Filed: Jan. 14, 1988

[30] Foreign Application Priority Data

Jan. 19, 1987 [AT] Austria ..... 83/87

[51] Int. Cl.[4] ..... C21D 9/52

[52] U.S. Cl. ..... 266/103; 266/111; 242/47.01

[58] Field of Search ..... 266/102, 103, 111, 110; 242/47.01, 47.08

[56] References Cited

U.S. PATENT DOCUMENTS

| | | | |
|---|---|---|---|
| 1,315,835 | 9/1919 | Hepworth | 148/156 |
| 2,622,860 | 12/1952 | Lorig | 266/103 |
| 2,965,368 | 12/1960 | McIluried | 148/156 |
| 3,325,620 | 6/1967 | Hunt et al. | 219/50 |
| 3,422,241 | 1/1969 | Bellem | 219/10.61 |
| 3,842,643 | 10/1974 | Large et al. | 72/286 |
| 4,364,728 | 12/1982 | Stamp | 432/8 |
| 4,421,304 | 12/1983 | Hesterlee | 266/103 |
| 4,620,884 | 11/1986 | Heath | 148/128 |

FOREIGN PATENT DOCUMENTS

| | | |
|---|---|---|
| 847707 | 2/1977 | Belgium . |
| 595364 | 4/1934 | Fed. Rep. of Germany . |
| 675130 | 3/1939 | Fed. Rep. of Germany . |
| 1270587 | 6/1968 | Fed. Rep. of Germany . |
| 2533288 | 2/1977 | Fed. Rep. of Germany . |
| 2701828 | 7/1977 | Fed. Rep. of Germany . |
| 57-94531 | 9/1982 | Japan . |
| 844238 | 8/1960 | United Kingdom . |
| 969191 | 9/1964 | United Kingdom . |
| 1114261 | 5/1968 | United Kingdom . |
| 1288767 | 9/1972 | United Kingdom . |

*Primary Examiner*—Christopher W. Brody
*Attorney, Agent, or Firm*—Marmorek, Guttman & Rubenstein

[57] ABSTRACT

In a device for heat-treating, in particular annealing, a continuously advanced metal wire, a heating chamber (1) which is substantially closed on all sides and whose wall has entry and exit openings (9) for the wire (8), which is wound in a multiplicity of adjacent windings around the two deflection drums (5), is arranged between two wire deflection drums (5) which are rotatably mounted at a distance from one another and axially parallel and have discrete wire guiding grooves (6) on their shell surfaces, at least one of the two deflection drums (5) being driven by a motor and heating elements (10) being arranged in the heating chamber (1) along the two groups (8*a*, 8*b*) of wire lengths passing back and forth through it (FIG. 2).

10 Claims, 2 Drawing Sheets

Figure 1:
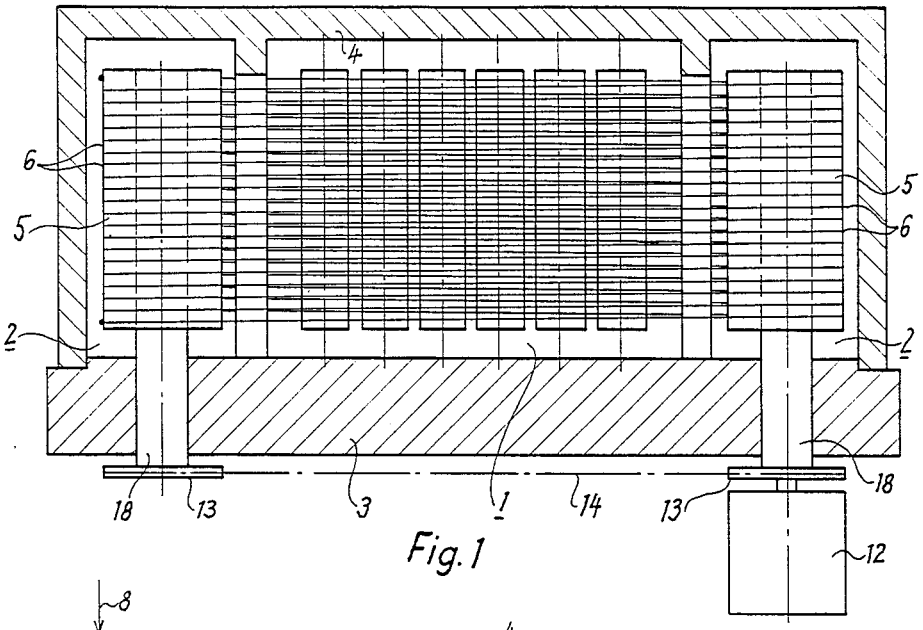

DEVICE FOR HEAT-TREATING, IN PARTICULAR ANNEALING, A CONTINUOUSLY ADVANCED METAL WIRE

Several devices are already known or have been proposed for heat-treating, in particular annealing, a continuously advanced metal wire, a relatively long residence time of the wire in the heat treatment zone combined with relatively small dimensions of the device as a whole being achieved by winding the wire in the heat treatment zone by a multiplicity of windings around at least one drum-like element of rotation which is rotated by a motor (cf. DE-C-595,364 and Austrian Patent Application Nos. A2578/86 of 26th September 1986 and A35/87 of 9th January 1987 by the assignee hereof).

The arrangement of a wire-wound drum directly in the heat treatment zone means that the drum itself is heated unduly and, in the case of an interruption in operations caused, for example by tangling of the wire, which is drawn off from a winder, continues to heat the wire in the winding zone even when otherwise the temperature in the heat treatment zone, for example due to the switching off of the heating elements and the opening of a housing surrounding the drum, is dropping This creates the risk that the particular lengths of wire will become burnt out and therefore useless.

Another disadvantage of arranging a wire-wound drum directly in the heat treatment zone is that this results in considerable difficulties with respect to the mounting of the drum, which is at a high temperature. This is particularly the case when, in accordance with the proposal contained in the earlier application A 35/87 and for reasons explained later, the drum is composed of a series of adjacent, mutually rotatable disc-like elements of rotation The object of the invention is therefore to design a heat treatment device for a continuously advanced wire in such a way that the wire can be guided through a heat treatment zone of moderate dimensions over as long a residence time as possible without the necessity of arranging drum-like elements of rotation, around which the wire is wound, in the heat treatment zone and which are heated to a high temperature, thereby causing the difficulties described above In a heat treatment device according to the invention, this object is achieved by a heating device which comprises first and second spaced deflection drums formed with wire-guiding grooves adapted to locate a wire wound in a multiplicity of adjacent windings around the first and second drums; means rotatably mounting the first and second drums with axes thereof substantially parallel to one another; a heating chamber located between the first and second drums and having a wall, portions of the wall in the regions of intersection with common outer tangential planes of the first and second drums being provided with entry and exit openings for the wire; at least one motor for driving at least one of the first and second drums; and heating elements mounted in the heating chamber along a transport path of the wire through the heating chamber.

In this device, the drums around which the wire is wound are located outside the heating chamber and are only heated by contact with the heated wire, i.e. substantially less than in earlier devices, with the additional result that, in the event of an interruption in operations, the heat transmitted back to the wire from each drum is substantially less and that, moreover, problems with regard to the mounting of the drums do not arise.

In a preferred exemplary embodiment, the heating chamber is formed by a base plate and an elongate, hood-like housing adapted to be fitted to and removed from the base plate, the housing having narrower end walls and longer side walls; and wherein the entry and exits openings are provided by slots in the end walls opening at the bottom edges thereof and running parallel to the drum axes; and wherein the heating elements are carried on the inner side of the housing side walls. The hood-like housing can thus be easily removed in order, on the one hand, when the device is first commissioned, to load it by winding wire round the drums an, on the other hand, in the case of an interruption in operations, to remove the heating elements out of their area of influence on the wire.

In order to permit thermal expansion and shrinkage of the wire both during operational heating up and during any cooling of the wire following an interruption in operations while maintaining contact between the wire and the rigid drum, it is advantageous if, in accordance with the earlier proposal mentioned above, the deflection drums are composed of mutually rotatable, disc-shaped elements of rotation, each of which has discrete wire-guiding grooves on its periphery. The disc-shaped elements of rotation can then rotate with respect to one another under friction, thereby in effect altering the loop angle. It is particularly advantageous if the diameters of the disc-shaped elements of rotation increase along at least one of the drum axes, in particular preferably overproportionately in relation to the thermal expansion of the wire to be expected along the drum. In spite of the heating up of the wire and the thermal expansion thus caused, this ensures that the wire remains in close contact with the drum shell during operation.

Figure 2:
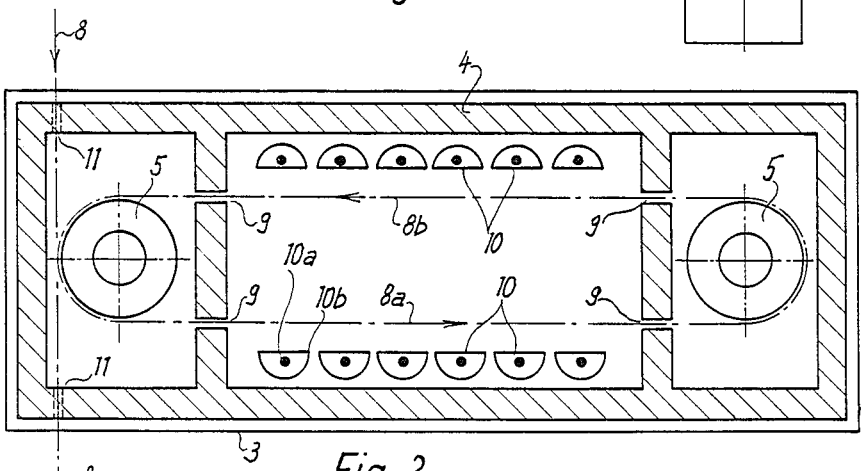
Figure 4:
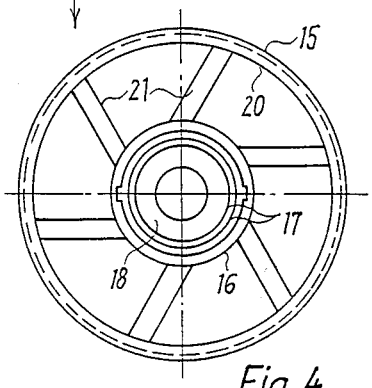
Figure 3:
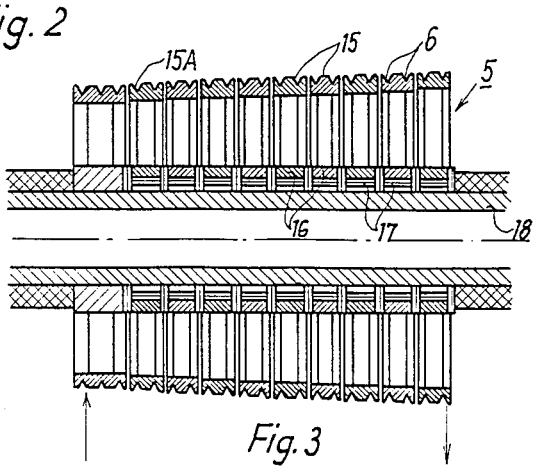
Figure 5:
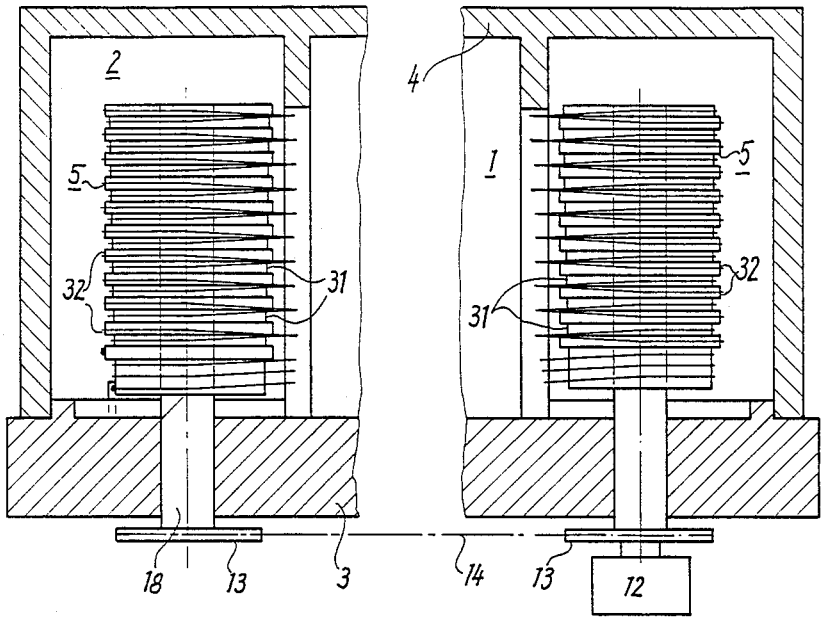
Figure 6:
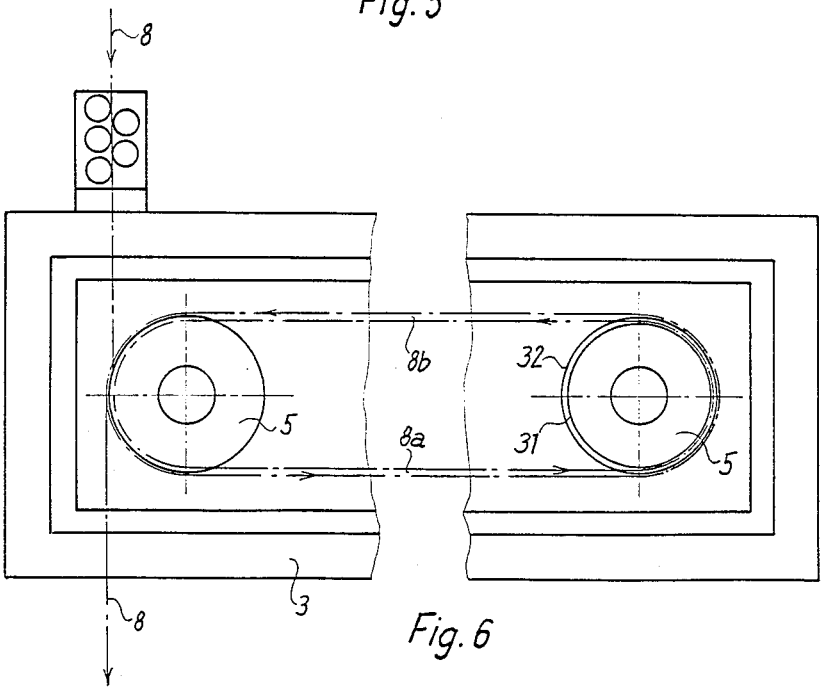

Further features and advantages of the invention will emerge from the following description of exemplary embodiments with reference to the drawings, in which:

FIGS. 1 and 2 show a vertical section and a horizontal section, respectively, through a first exemplary embodiment, FIG. 3 shows a preferred embodiment of a deflection drum in axial section, FIG. 4 shows a plan view of one of the disc-shaped elements of rotation of which the deflection drum according to FIG. 3 is composed, and FIGS. 5 and 6 show an advantageous further development of a device according to the invention in vertical section and in plan view with the housing removed, respectively.

The device according to FIGS. 1 and 2 has a heating chamber 1, which is formed by a base plate 3 and a removable, hood-like housing 4 of heat-insulating material and advantageously has receiving chambers 2, upstream and downstream, for the deflection drums 5, which, according to the invention, are arranged outside the heating chamber 1. In the regions of intersection with the common outer tangential planes of the two deflection drums 5, slots 9 which run parallel to the axes of the deflection drums, start from the base of the housing and serve as entry and exit openings to the chamber 1 for groups of wires 8*a* and 8*b*, which move back and forth and are formed by the winding of the two deflection drums 5 with a multiplicity of windings of the wire 8, the slots being made in the two housing walls which are located at the narrow ends of the elongate heating chamber 1. The formation of these entry and exit openings by slots which start from the base of the housing allows the hood-like housing 4 to be removed and placed in position while retaining the operational arrangement of the wire 8 on the deflection drums 5 and in the region of the chamber 1.

To enable the space under the hood-like housing to be filled where necessary with a blanketing gas in a manner known per se, it is possible to provide bores (not shown) in the base plate 3. In addition, the whole device can be surrounded by a larger hood filled with blanketing gas so that, in the event of an interruption in operations, the wire can continue to cool in an adequate blanketing gas atmosphere after the hood-like housing 4 has been removed.

In accordance with the way in which the wire is guided, one of the receiving chambers 2 for the deflection drums 5 has entry and exit apertures 11, arranged inside the heat treatment device, for the wire 8 continuously passing through. It is also possible to provide the entry aperture for the wire in one of the chambers 2 and the exit aperture for the wire in the other chamber 2.

In the simplest case, the deflection drums can be cylindrical rolls having, on their shell surface discrete wire-guiding grooves 6, the depth of which is such that the wire 8 taken up by them cannot fall out of the grooves even allowing for the thermal expansion which occurs. In this embodiment, it is possible, using a wire take-off device (not shown) downstream of the heat treatment device to keep the wire under tension to a degree such that, despite expanding when heated up, it remains in contact with the drums 5.

At least one of the drums 5 can be driven by a motor 12 and, as shown in FIG. 1, both drums may also, if desired, be connected by means of sprockets 13 and a chain 14 so as to rotate in common.

Rows of heating elements 10 at the chamber walls are fitted on each side of the transport path of the groups of wires 8*a* and 8*b* traversing the heating chamber 1. However, it is also possible to provide just one row of heating elements, either at the side or in the centre between the transport paths of both groups of wires 8*a* and 8*b*. They may be simple radiant heating elements but, as indicated in FIG. 2, heating bars 10*a* arranged in the focal line of reflectors 10*b* are preferably used The reflectors 10*b* can be designed so as to rotate about the axes of th-e heating bars 10*a*. In the event of an interruption of operations this arrangement makes it possible to switch off the energy supply to the heating bars and at the same time to rotate the reflectors by 180° so that the residual energy remaining in the heating bars is given off towards the walls of the housing and not towards the groups of wires 8*a*, 8*b*. In the event of a fault, the energy supply to the groups of wires can in this way be interrupted within a very short time FIGS. 3 and 4 illustrate an advantageous structure of the deflection drums 5. In accordance with FIG. 3, the deflection drum is composed of mutually rotatable, disc-shaped elements of rotation 15, each of which has discrete wire-guiding grooves 6 on its periphery In the case of least one drum 5, the diameters of the disc-shaped elements of rotation preferably increase along the drum axis, in particular preferably overproportionately in relation to the thermal expansion and tensile strain to be expected along the drum According to FIGS. 3 and 4, the hubs 16 of the disc-shaped elements of rotation 15 are mounted rotatably and with a frictional connection on a driven shaft 18 by means of bushes 17, with the exception of the first disc-shaped element of rotation 15A, which is rotationally solid with the shaft 18.

When the shaft 18 is driven by the motor 12 in FIG. 1, this arrangement has the effect that, for the same angular velocity of all the disc-shaped elements of rotation, the circumferential velocity increases in the direction of the drum axis. By this means, the wire, which becomes gradually hotter during its passage through the device, remains in constant contact with the wire-guiding grooves 6 of the drum 5 around which it is partly wound because the successive discs have the tendency to carry the wire along at an increased speed and therefore put the latter under strain.

In order to keep the heat retention capacity of the individual elements of rotation 15 as low as possible, it is possible, in accordance with FIG. 4, to design them as spoked wheels having a thin wheel rim which exhibits wire-guiding grooves 6 and is connected by spokes 21, which may be designed as cooling vanes, with the wheel hub 16.

FIGS. 5 and 6 show a further advantageous exemplary embodiment of the wire deflection drums arranged upstream and downstream of a heating chamber 1 (indicated in schematic form only). Differing disc-shaped elements of rotation 31 and 32 which are mutually rotatable and are driven by friction are arranged in alternation on the drive shafts 18 of both these drums. It is advantageous if, in accordance with FIG. 3, the diameters of the disc-shaped elements of rotation 31 increase stepwise from a minimum to a maximum value, while the disc-shaped elements of rotation 32 have the same diameter throughout although this should be greater than the maximum diameter of the disc-shaped elements of rotation 31.

Beginning initially at the bottom and progressing upwards a wire 8 can thus be wound round the two deflection drums 5 in such a way that it is in all cases wound round only the grooved disc-shaped elements of rotation 31. As soon as the wire reaches the topmost disc-shaped element of rotation 31 of one drum 5 it is guided to the topmost disc-shaped element of rotation 32 of the other drum 5, upon which, in the downward direction, but now touching only the grooved disc-shaped elements of rotation 32, it is guided back to the level at which it entered the device During this procedure, the lengths of the wire which are wound round the elements of rotation 30 and those which are wound round the elements of rotation 31 cross one another in the space without making contact This arrangement doubles the resulting residence time in the heating chamber for the same wire throughout speed and, in addition, it means that the entry and exit openings 11 in the housing 4 in FIG. 2 are arranged in alignment They can therefore each be formed by short slots starting from the base of the housing 4.

We claim:

1. A device for heat-treating a single continuously advancing metal wire, said device comprising first and second spaced deflection drums formed with wire-guiding grooves adapted to locate said single wire wound in a multiplicity of adjacent windings around said first and second drums; means rotatably mounting said first and second drums with axes thereof substantially parallel to one another; a heating chamber located between said first and second drums and having a wall, portions of said wall in the regions of intersection with common outer tangential planes of said first and second drums being provided with entry and exit opening for said wire; said single wire being wound in helical fashion about said first and second drums a multiplicity of times and passing through said heating chamber multiple times; at least one motor for driving at least one of said first and second drums; and heating elements mounted in said heating chamber along a transport path of said wire through said heating chamber.

2. A device according to claim 1, wherein said heating chamber is formed by a base plate and an elongate hood-like housing adapted to be fitted to and removed from said base plate, said housing having narrower end walls and longer side walls; and wherein said entry and exits openings are provided by slots in said end walls opening at the bottom edges thereof and running parallel to said drum axes; and wherein said heating elements are carried on the inner side of said housing side walls.

3. A device according to claim 1, wherein said first and second drums are substantially enclosed within first and second receiving chambers respectively, said receiving chambers being provided one at each end of said heating chamber; one of said receiving chambers being provided with an entry aperture for said wire to said device, and one of said receiving chambers being provided with an exit aperture for said wire from said device.

4. A device according to claim 2 and claim 3, wherein said housing is formed integrally with parts interacting with said base plate to form said receiving chambers.

5. A device according to claim 1, wherein at least one of said first and second drums is composed of mutually rotatable, essentially disc-shaped elements of rotation, each of said elements being provided with at least one discrete wire-guiding groove in the periphery thereof.

6. A device according to claim 5, wherein the diameters of said elements increase along the axis of at least one of said drums.

7. A device according to claim 6, wherein said diameters increase overproportionately in relation to expansion of said wire to be expected along said drum.

8. A device according to claim 5, wherein each of said first and second drums has, in the axial direction thereof, alternating ones of said elements of lesser and greater diameter, whereby said windings are adapted to extend successively around said elements of greater diameter from one end of each said drum to the other end thereof, and back again around said elements of lesser diameter.

9. A device according to claim 1, wherein said heating elements are formed by heating bars having reflectors, and means pivoting said reflectors between positions in which said reflectors radiate heat towards said transport path of said wire windings, and a position in which said wire windings are shielded from radiated heat.

10. A device according to claim 1, wherein said heating chamber is filled with a blanketing gas.

* * * * *